United States Patent [19]

Harabayashi

[11] Patent Number: 5,035,418

[45] Date of Patent: Jul. 30, 1991

[54] CYCLE TYPE ATHLETIC EQUIPMENT

[75] Inventor: Masao Harabayashi, Kawagoe, Japan

[73] Assignee: Tokyo Sintered Metals Corp., Tokyo, Japan

[21] Appl. No.: 392,376

[22] Filed: Aug. 10, 1989

[30] Foreign Application Priority Data

Aug. 10, 1988 [JP] Japan ..... 63-197835
Mar. 1, 1989 [JP] Japan ..... 1-46565

[51] Int. Cl.[5] ..... A63B 23/04

[52] U.S. Cl. ..... 272/73; 272/33 B; 272/17

[58] Field of Search ..... 272/73, 18, 66, 1 C, 272/146, 97, 146, 17

[56] References Cited

U.S. PATENT DOCUMENTS

| | | | |
|---|---|---|---|
| 1,789,680 | 1/1931 | Gwinnett | 272/118 |
| 2,524,238 | 10/1950 | Soule | 272/1 C |
| 2,623,302 | 12/1952 | Shields | 272/73 |
| 3,750,479 | 8/1973 | Gause et al. | 272/73 |
| 4,509,742 | 4/1985 | Cones | 272/73 |
| 4,711,447 | 12/1987 | Mansfield | 272/73 |
| 4,743,012 | 5/1988 | Kim | 272/73 |
| 4,850,588 | 7/1989 | Dosjardins et al. | 272/97 |

FOREIGN PATENT DOCUMENTS

| | | |
|---|---|---|
| 2436594 | 2/1976 | Fed. Rep. of Germany . |
| 2756085 | 6/1979 | Fed. Rep. of Germany . |
| 2493159 | 5/1982 | France . |
| 2602150 | 2/1988 | France . |
| WO88/09688 | 12/1988 | World Int. Prop. O. . |

*Primary Examiner*—Stephen R. Crow
*Attorney, Agent, or Firm*—Young & Thompson

[57] ABSTRACT

A cycle type athletic equipment comprising a seat, handlebars positioned to be gripped by a user sitting on the seat, rotary pedals positioned to be pedaled by the legs of a user, a flywheel driven by the rotary pedals and subjected to an adjustable load, and a movable support for supporting the seat and handlebars and rotary pedals and flywheel. Actuators are provided, for tilting the movable support forward, backward and to the right and left sides.

3 Claims, 17 Drawing Sheets

CYCLE TYPE ATHLETIC EQUIPMENT

BACKGROUND OF THE INVENTION

1. Field of the Invention

The present invention relates to a cycle type athletic equipment which is used as a health equipment or a training equipment for building up one's physical strength by pedaling with legs of a user.

2. Related Art Statement

Hitherto, there have been known some cycle type athletic equipments. For example, Japanese Patent Application Publication No. 61-44511 discloses a health equipment wherein the positions of a handlebar and a saddle seat are changed relatively to a stationary frame by means of a motor in response to a load of a pair of pedals which is pedaled with legs of a user who is seated on the saddle seat to thereby cause the user to take a forwardly inclined posture. Japanese Utility Model Laid-open Publication No. 61-36651 discloses a cycle trainer wherein a handlebar and a saddle seat are interlocked to move before and behind in response to the rotation of a pair of rotary pedals. In addition, Japanese Patent Application Laid-open Publication No. 60-68871 discloses a different type of an athletic equipment including a stationary seat and a pair of rotary pedals which is rotated under a pedal load at a fixed position spaced from the seat by a proper distance so that the rotary pedals are pedaled by legs of a user who sits on the seat and leans on a seat back thereof to thereby train the strength of the legs.

As mentioned above, the conventional cycle type athletic equipments are constructed such as to train the strength of the legs of user at a stationary position or to train the legs and the sense of equilibrium by tilting the handlebar and the saddle seat backward and forward, but not to both sides during pedaling. However, in actual cycling, there are not only a straight road, but also meandering upward and downward slopes. On such meandering slopes a rider is required to balance himself by inclining his riding posture front and rear as well as both sides, but the prior athletic equipments have no complicated training function for satisfying such requirements. Recently, there has been strongly demanded to enhance training effect or amusements by imposing a severe riding posture on a user.

SUMMARY OF THE INVENTION

It is an object of the invention to provide a cycle type athletic equipment which can tilt the seat and the handlebar to any optional angle in any desired direction during pedaling for hardening the strength of legs, cultivating the sense of equilibrium and enabling more complicated training.

The cycle type athletic equipment according to the present invention comprises a seat, a handlebar positioned to be gripped by a user who sits on the seat, a pair of rotary pedals positioned to be pedaled by legs of the user, movable support for supporting the seat and handlebar and actuating means for tilting the movable support forward, backward and both sides.

According to the invention, since a handle post and a seat pillar can be used in the condition of tilting pitching and rolling, a user can train not only the physical strength of legs but also an arm muscle, a pectoral muscle, an abdominal muscle and the like, and further cultivate the sense of equilibrium by gripping a handlebar and working the pedals with any tilting posture.

These and other objects, features and advantages of the invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

FIGS. 12*a*–13*d* and FIGS. 13*a*–13*c* are operational explanatory views of the athletic equipment shown in FIG. 9;

DETAILED DESCRIPTION OF THE PREFERRED EMBODIMENTS

Figure 1:
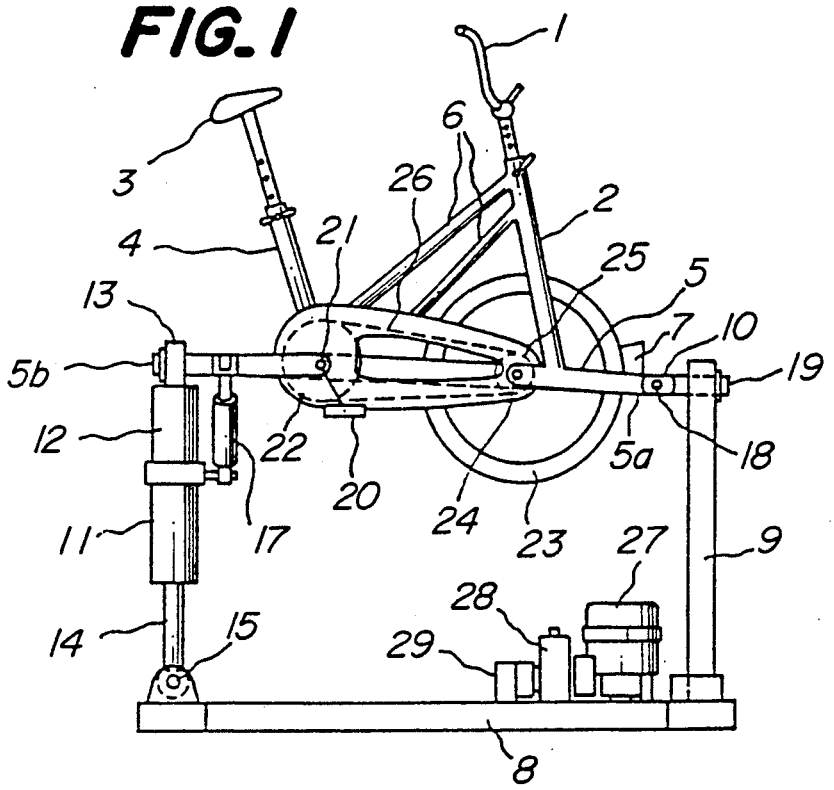
FIG. 1 is a side view of a cycle type athletic equipment of a first embodiment of the invention.
Figure 2:
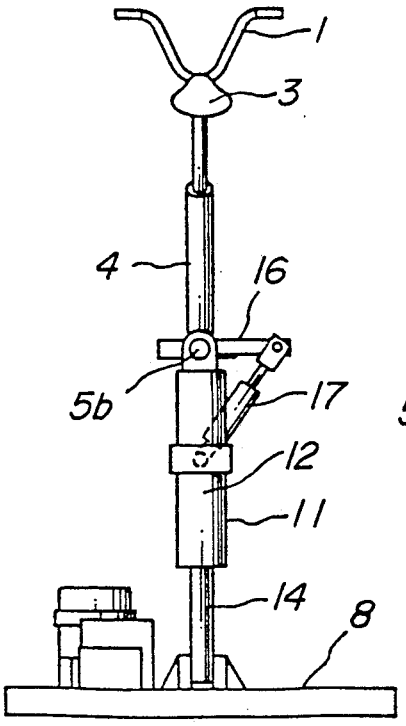
FIG. 2 is a back view of the athletic equipment shown in FIG. 1.
Figure 3:
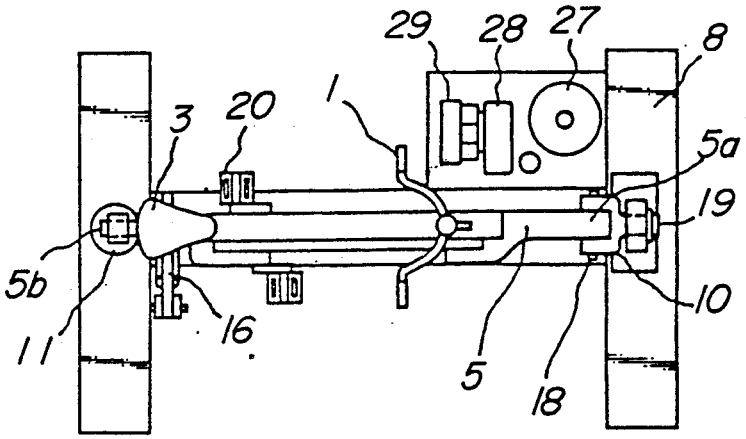
FIG. 3 is a plan view of the athletic equipment shown in FIG. 1.
Figure 4A:
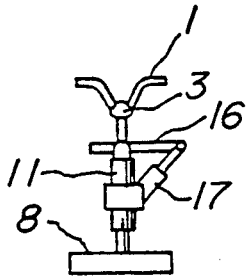
FIGS. 4*a*–4*p* are operational explanatory views of the athletic equipment shown in FIG. 1.
Figure 4B:
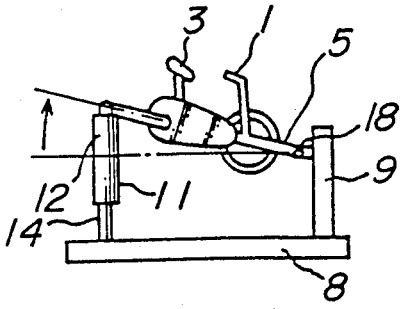
Figure 4C:
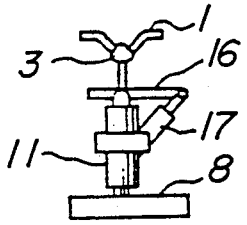
Figure 4D:
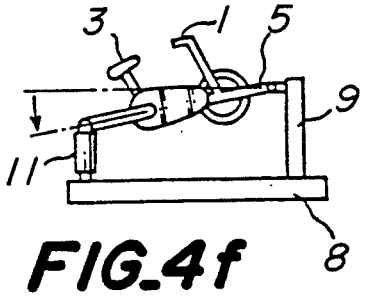
Figure 4E:
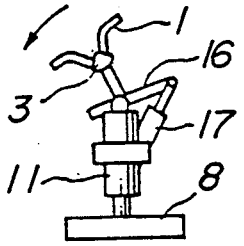
Figure 4F:
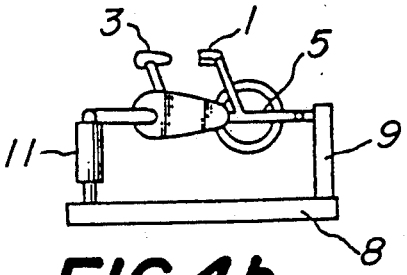
Figure 4G:
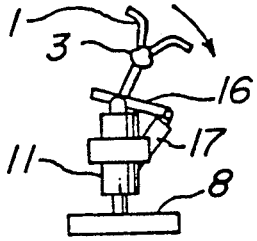
Figure 4H:
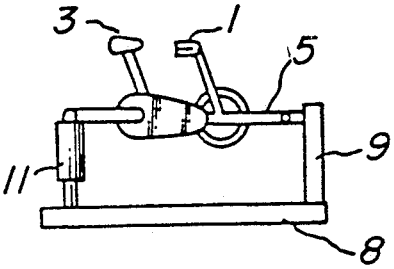
Figure 4I:
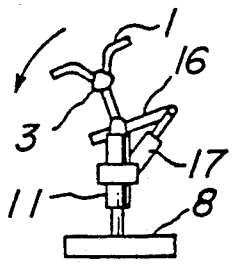
Figure 4J:
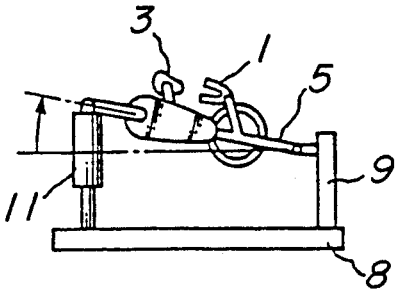
Figure 4K:
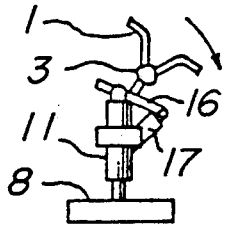
Figure 4L:
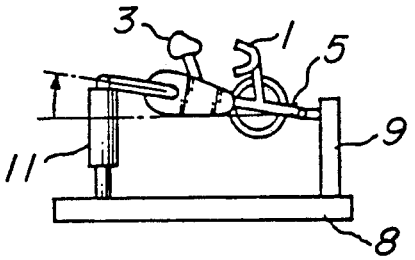
Figure 4M:
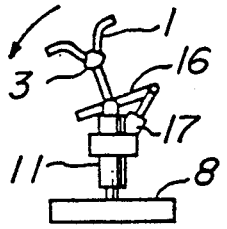
Figure 4N:
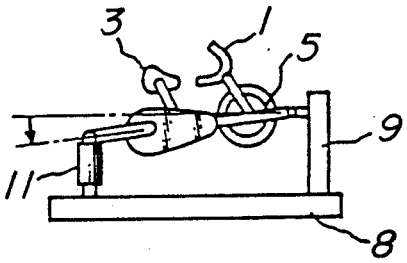
Figure 4O:
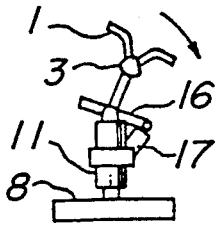
Figure 4P:
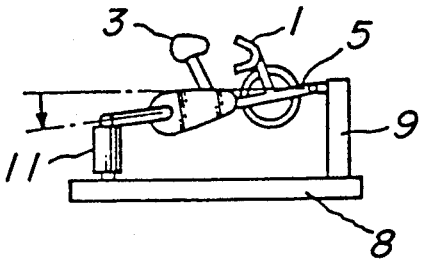
Figure 5:
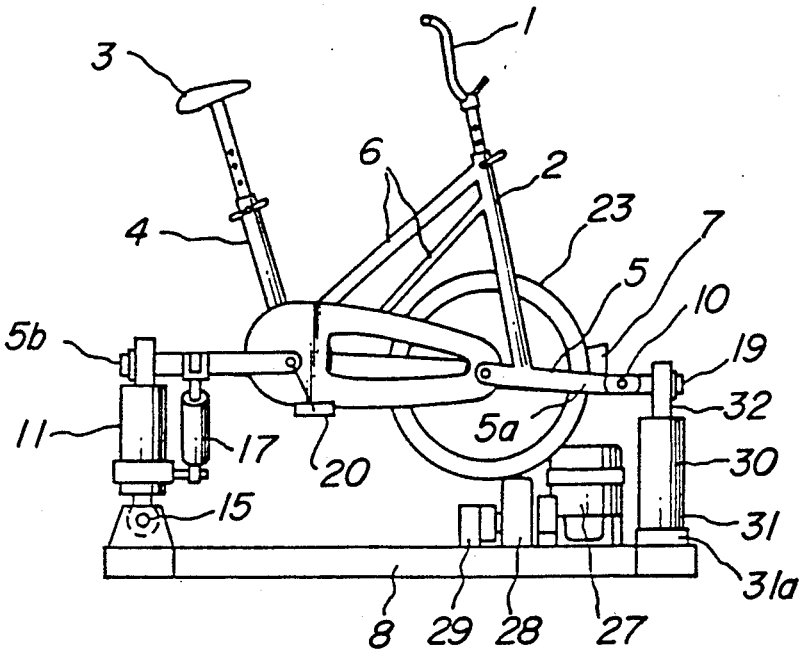
FIG. 5 is a side view of the cycle type athletic equipment according to a second embodiment of the invention.
Figure 6:
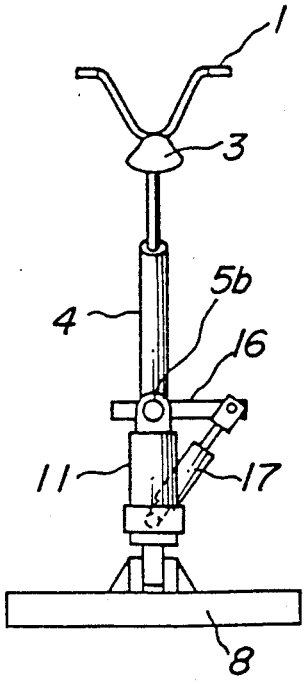
FIG. 6 is a back view of the athletic equipment shown in FIG. 5.
Figure 7:
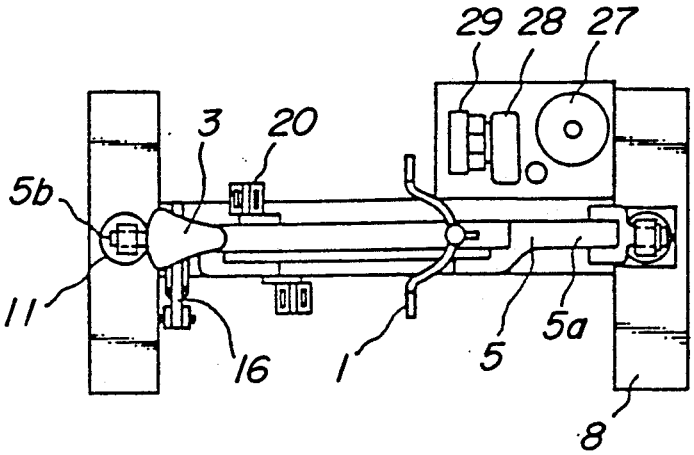
FIG. 7 is a plan view of the athletic equipment shown in FIG. 5.

A first embodiment of the invention is shown in FIGS. 1–4. In this embodiment, a handlebar 1 is adjustably attached to the upper end of a handlebar post 2 and a saddle seat 3 is also adjustably attached to the upper end of a seat pillar 4 in a known manner so as to adjust the height of the handlebar 1 and the seat 3, respectively. The handle post 2 and the seat pillar 4 are fixed at predetermined angles on a movable support 5, in the form of a pipe, respectively and the handle post 2 and the seat pillar 4 are connected by stay pipes 6.

The support 5 is connected at its front end 5*a* to the upper end of a fixed post 9 on a supporting stand 8 by means of a universal joint 10, a rear end 5*b* of the support 5 is also connected to the upper end of a telescopically extensible post 11, that is, the upper end of a hydraulic cylinder 12 composed of a tilting actuating device, by means of a universal joint 13 and the lower end of the extensible post 11, that is, the outer end of a piston 14 is pivotally secured to the supporting stand 8 at a pin 15.

An arm 16 is laterally projected from the rear end portion of the support 5, and the free end of this arm 16 is connected to a suitable portion of the extensible post 11 by a hydraulic cylinder 17.

According to the above mentioned construction, when the extensible post 11 is actuated, as shown in FIGS. 4*a*, 4*b*, 4*c* and 4*d*, the movable support 5 is moved up and down at the rear end thereof to move the support 5 from the horizontal position to the forwardly inclined position and the rearwardly inclined position, respectively, by tilting around a horizontal pin 18 of the universal joint 10, and the positions of the handlebar 1 and the saddle seat 3 can be tilted correspondingly.

Moreover, as shown in FIGS. 4*e*–4*p*, at the horizontal position, the downward position and upward position of the movable support, respectively, the support 5 is tilted to both sides around its longitudinal axis 19 through the universal joint 10 by controlling the hydraulic cylinder 17, thereby tilting the handlebar 1 and the saddle seat 3.

A crank axle 21 of a rotary pedal 20 is rotatably fitted to the support 5 by means of a bearing, a pulley 22 is fixed to the crank axle 21 of the pedal 20, a pulley 25 is fixed to a rotating shaft 24 of a wheel 23 which is rotatably fitted to the support 5. A V belt 26 is engaged with both the pulleys 22 and 15, a control load piece 7 adjustably loaded by a spring (not shown) is pressed against the wheel 23, thereby giving load to the pedal 20.

On the supporting stand 8 are provided a motor-driven hydraulic pump 27, an oil tank 28 and a solenoid valve 29 of a hydraulic circuit which is arranged to control the solenoid valve 29 by a grip, a lever, a push button or the like provided on the handlebar 1 to thereby three-dimensionally incline the movable support.

In the illustrated embodiment, a hydraulic oil is used as a working medium of the hydraulic cylinder, but compressed air can naturally be used. Moreover, it is also possible to automatically control the hydraulic cylinder by a previously determined computer program.

Referring to FIGS. 5–8 illustrating a second embodiment of the invention, this embodiment provides an extensible post 30 instead of the fixed post 9 in the first embodiment for supporting the front end 5*b* of the movable support 5. In the illustrated embodiment, the extensible post 30 is composed of a hydraulic cylinder 31, which is fixed at a base end 31*a* to the stationary supporting stand 8, and the front end 5*a* of the movable support 5 is connected to the upper end of a piston 32 through a universal joint 10.

Figure 8A:
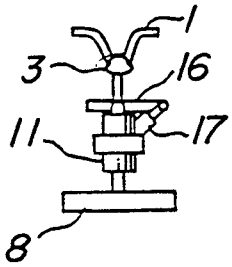
FIG. 8*a*–8*p* are operational explanatory views of the athletic equipment shown in FIG. 5.
Figure 8B:
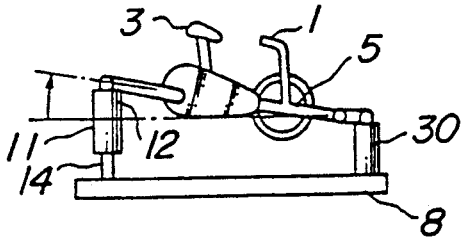
Figure 8C:
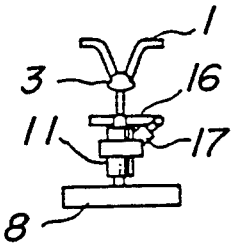
Figure 8D:
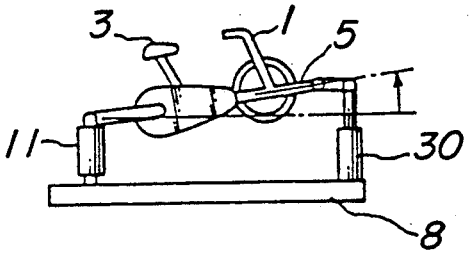
Figure 8E:
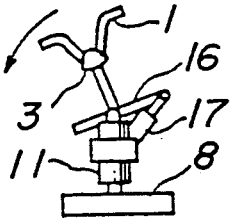
Figure 8F:
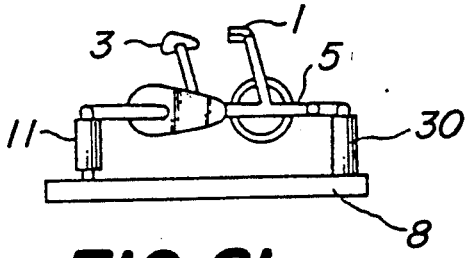
Figure 8G:
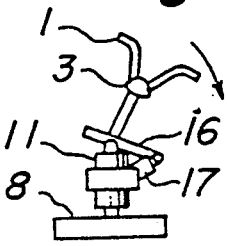
Figure 8H:
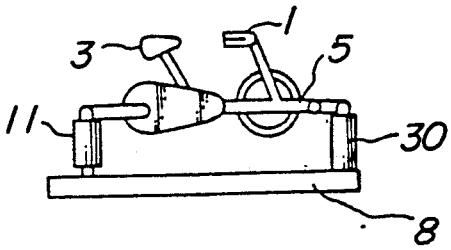
Figure 8I:
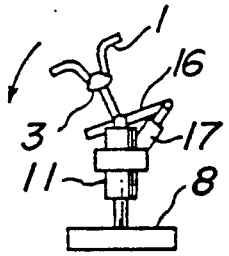
Figure 8J:
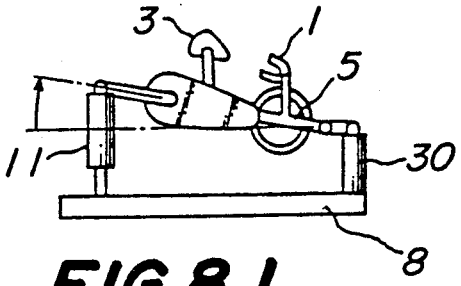
Figure 8K:
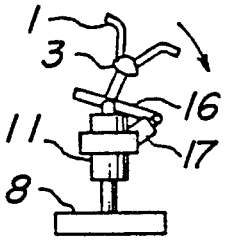
Figure 8L:
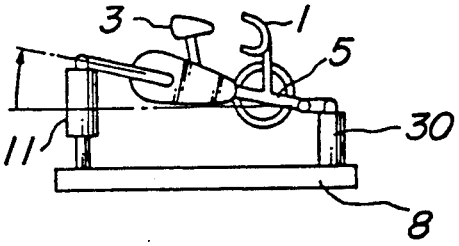
Figure 8M:
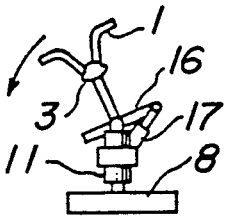
Figure 8N:
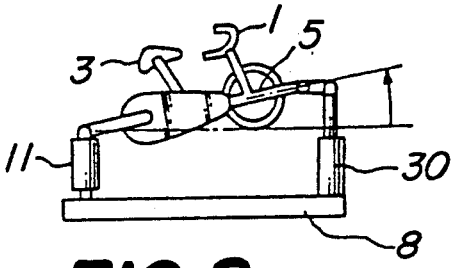
Figure 8O:
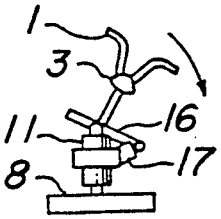
Figure 8P:
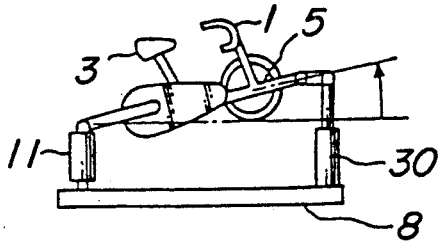

In this embodiment, as shown in FIGS. 8*f* and 8*h*, when both the front and rear extensible posts 30 and 11 are contracted, the movable support 5 is at the horizontal position and as shown in FIG. 8*d*, 8*n* and 8*p*, when only the front post 30 is extended, the support 5 becomes a rearwardly inclined position from the horizontal position, and as shown in FIGS. 8*b*, 8*j* and 8*l*, when only the rear post 11 is extended, the support 5 becomes a position forwardly inclined to the horizontal.

Referring to FIGS. 9–13 illustrating a third embodiment of the invention, the movable support 5 is composed of a rectangular plate and is supported at four corners by each of extensible posts 40 composed of a hydraulic cylinder which is connected at the upper and lower ends to the movable support 5 and the stationary stand 8 through universal joints, respectively. The movable support 5 is also supported at the center by a nonextensible central post 41 which is connected at the lower end to the stand 8 through a universal joint. These posts are enclosed with a skirt 42 extending between the movable support 5 and the stationary stand 8.

Figure 9:
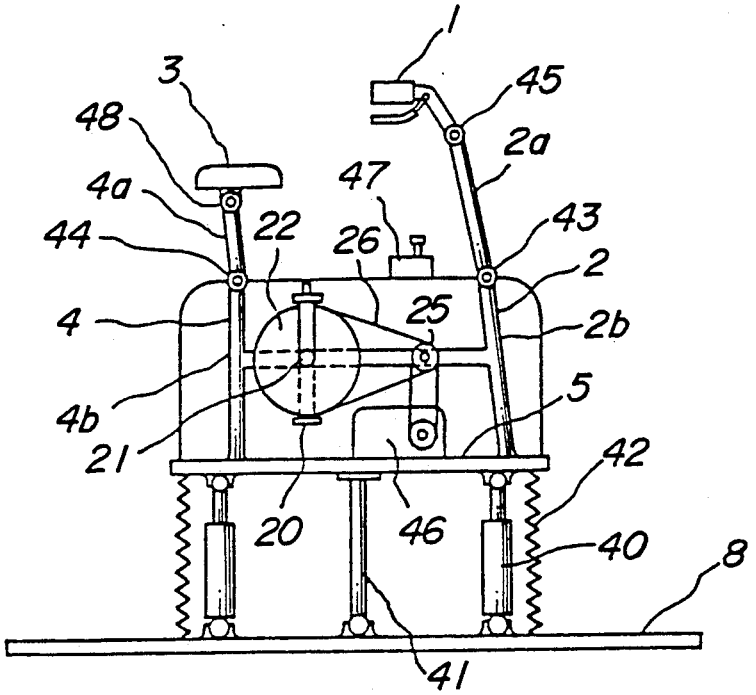
FIG. 9 is a side view of the cycle type athletic equipment according to a third embodiment of the invention.

In this embodiment, the handle post 2 and the seat pillar 4 are composed of two separate portions of upper and lower portions 2*a*, 2*b* and 4*a*, 4*b*, respectively. The lower portions 2*b* and 4*b* are fixed at their lower ends to the movable support 5, and the upper portions 2*a* and 4*a* are adjustably connected to the upper ends of the fixed lower portions 2*b*, 4*b* by conventional joints 43, 44 as shown in FIG. 9. Moreover, the handlebar 1 and the saddle seat 3 are adjustably fitted to the upper portion 2*a* of the handle post 2 and the upper portion 4*a* of the seat pillar 4, respectively, by conventional joints 45 and 48.

The V belt 26 is extended over the pulley 22 fixed to the crank axle 21 of the pedal 20 to drive a cycloid pump 46 and thereby generating a hydraulic pressure. A relief amount of the hydraulic pressure is regulated by a relief valve provided in a supply line at the discharge side of the pump and a load torque applied to the pedal is changed by a control lever provided in a select lever box 47 within a range of 0–400 kg·cm.

Further, the cycloid pump 46 is utilized as a pressure source for the extensible posts 40, and the hydraulic flow from the pump is controlled to actuate the extensible posts 40 to thereby cause the movable support 5 to incline forward, backward and both sides as shown in FIGS. 12*a*–12*d*.

Figure 14:
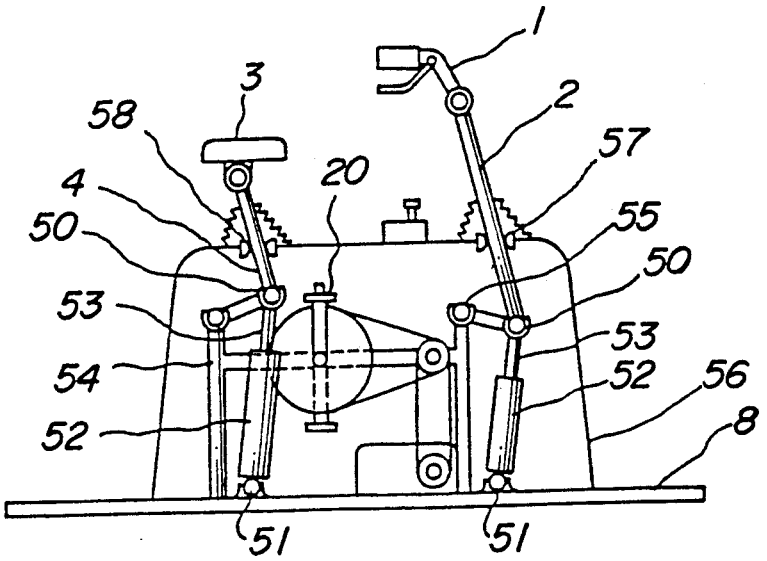
FIG. 14 is a side view of the cycle type athletic equipment according to a fourth embodiment of the invention.
Figure 15:
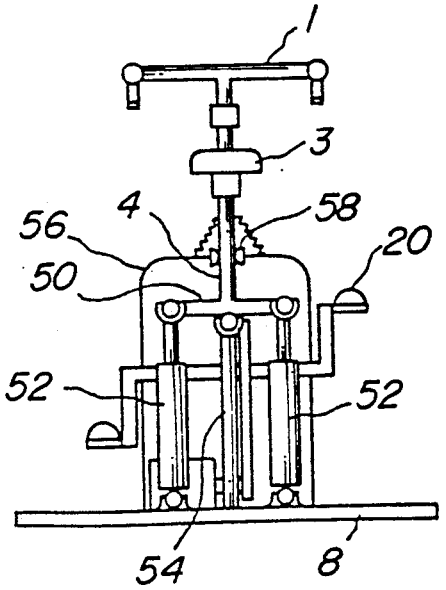
FIG. 15 is a back view of the athletic equipment shown in FIG. 14.
Figure 16:
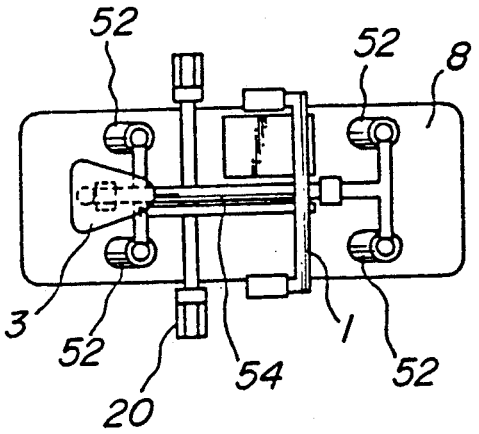
FIG. 16 is a plan view of the athletic equipment shown in FIG. 14.
Figure 17A:
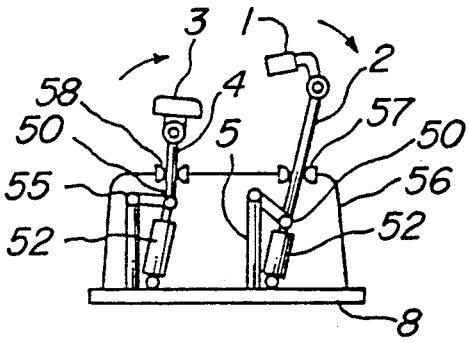
FIGS. 17*a*–17*d* are operational explanatory views of the athletic equipment shown in FIG. 14.
Figure 17B:
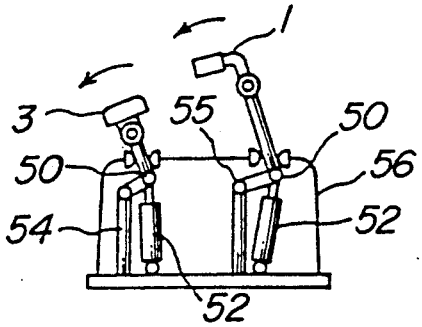
Figure 17C:
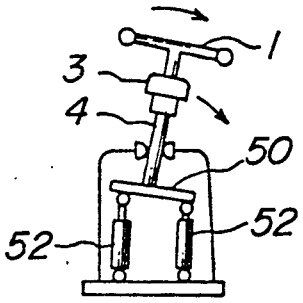
Figure 17D:
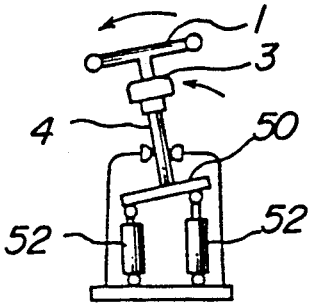
Figure 18:
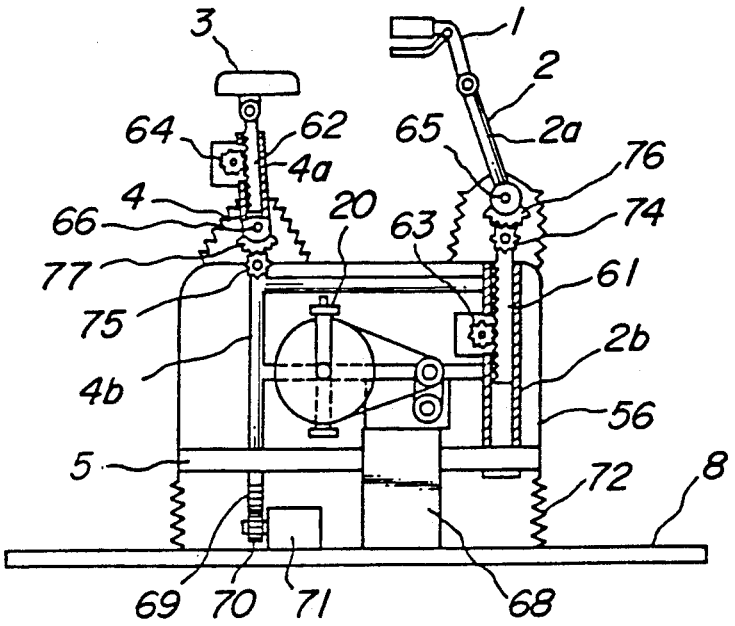
FIG. 18 is a side view of the cycle type athletic equipment according to a fifth embodiment of the invention.
Figure 19:
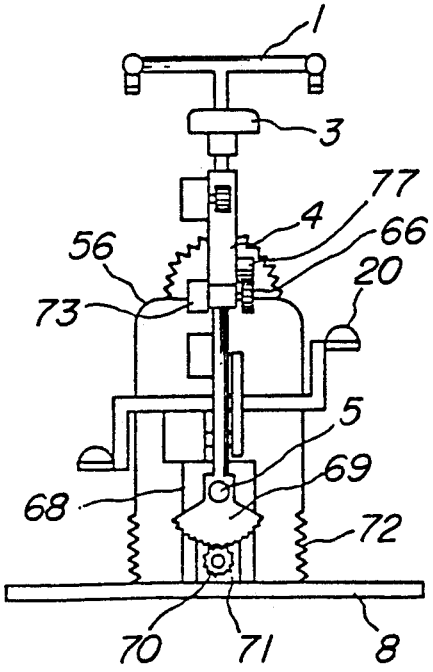
FIG. 19 is a back view of the athletic equipment shown in FIG. 18.
Figure 20:
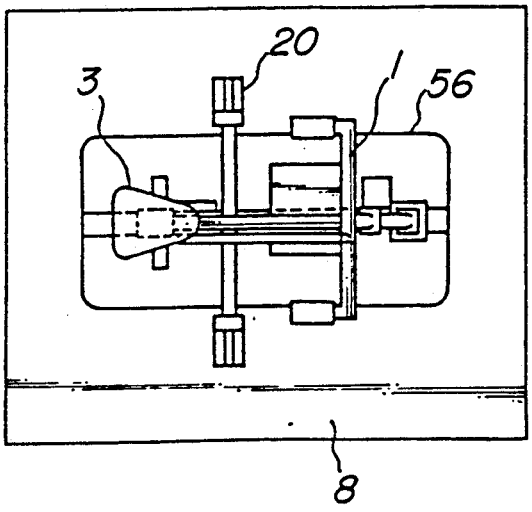
FIG. 20 is a plan view of the athletic equipment shown in FIG. 18.

Referring FIGS. 14–16 illustrating a fourth embodiment of the invention, the lower end of each of the handle post 2 and the seat pillar 4 is rigidly secured to the center of an individual movable support 50. Each movable support extends in the transverse direction, and is connected at both ends thereof to the upper end of a piston 53 of an extensible post 52 in the form of a hydraulic cylinder by a universal joint. The lower end of the extensible post 52 is also movably connected to the supporting stand 8 by a universal joint 51. Each movable support 50 is connected to the upper end of a fixed supporting frame 54 by a universal joint 55, and suitable portions of the handle post 2 and the seat pillar 5 are supported by supporting holes 57, 58 of a housing 56, respectively.

Therefore, the handlebar 1 and the seat 2 can be tilted as shown in FIGS. 17*a*–17*d* by actuating and controlling the extensible post 52.

FIGS. 18–21 illustrate a fifth embodiment of the invention. In this embodiment, as an actuator for tilting the handle bar and the saddle seat, a gearing is mainly used instead of the hydraulic cylinder in the above embodiments, and is actuated by an electric motor.

As illustrated, the handlebar 1 and the saddle seat 3 are adjusted in height by means of racks 61, 62 and pinions 63, 64 on the handle post 2 and seat pillar 4 munually or electrically, respectively.

The handle post 2 and the seat pillar 4 are composed of upper portions 2*a*,4*a* and lower positions 2*b*, 4*b*, respectively. The lower portions 2*b*, 4*b* are provided at the upper end with pinion 74, 75 which are rotated by reversible motors (one of which is shown by 73), and are meshed with sector gears 76, 77 fixed to the upper portions 2*a*, 4*a* so as to tilt the upper portions 2*a*, 4*a* by motors, respectively.

The lower portions 2*b*, 4*b* are fixed to a rod shaped movable support 5 which is rotatably supported o the supporting post 8 by a bearing 68 and is provided with a sector gear 69. The sector gear 69 is meshed with a pinion 70 which is driven by a reversible motor 71 on the supporting stand 8 thereby tilting the movable support 5 towards each side. Reference numeral 72 designates an extensible skirt provided at the lower end of the housing 56.

Figure 21A:
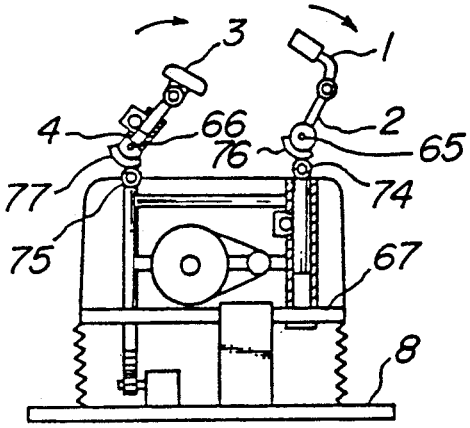
FIGS. 21*a*–21*d* are operational explanatory views of the athletic equipment shown in FIG. 18.
Figure 21B:
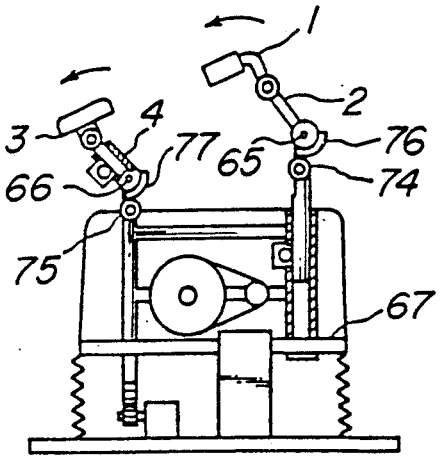
Figure 21C:
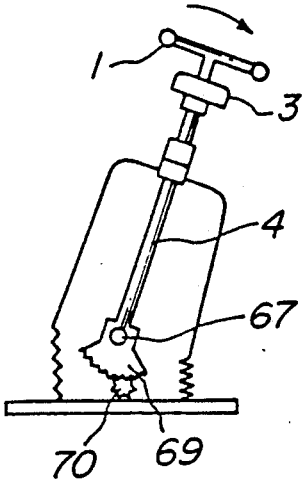
Figure 21D:
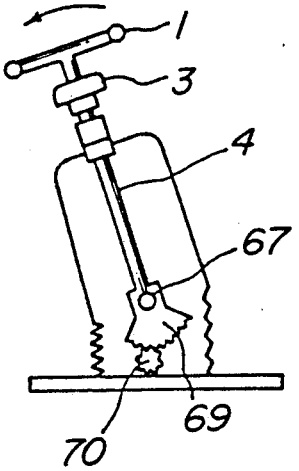

According to the above construction, it is possible to independently tilt the handlebar 1 and the saddle seat 3 before and behind as shown in FIGS. 21*a* and 21*b* around pin 65, 66 by means of pinions 74, 75 and sector gears 76, 77 by the reversible motor and also to tilt them towards each side as shown in FIGS. 21*c* and 21*d* around the longitudinal axis of the movable support 5 by means of a pinion 70 and sector gear 69 by the reversible motor 71.

Figure 10:
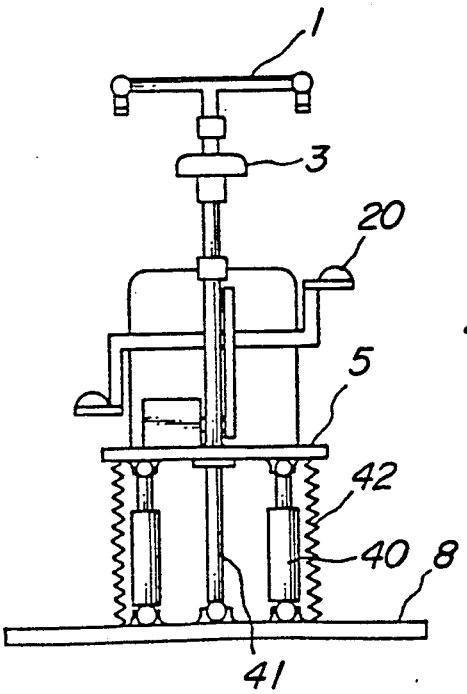
FIG. 10 is a back view of the athletic equipment shown in FIG. 9.
Figure 11:
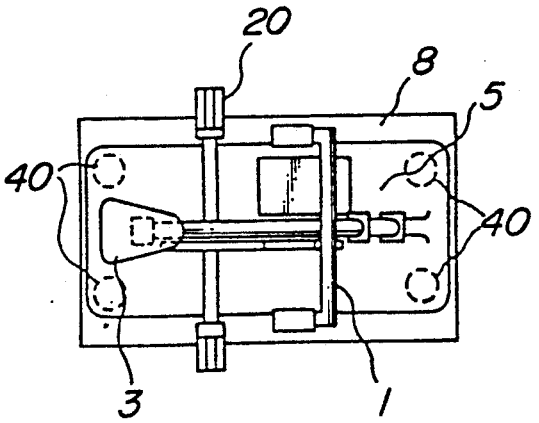
FIG. 11 is a plan view of the athletic equipment shown in FIG. 9.
Figure 12A:
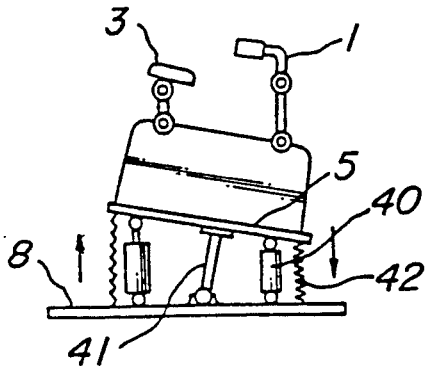
Figure 12B:
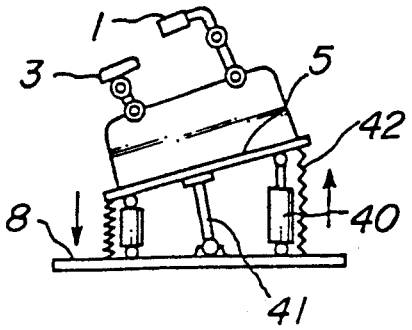
Figure 12C:
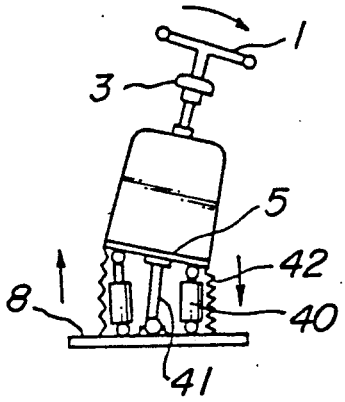
Figure 12D:
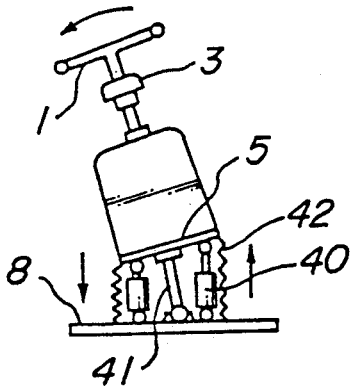
Figure 13A:
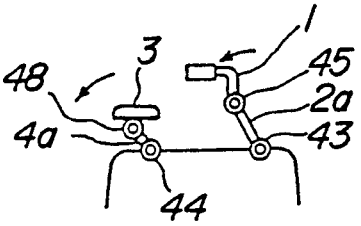
Figure 13B:
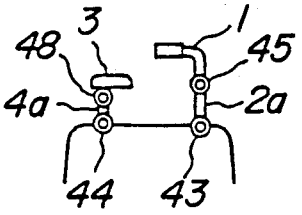
Figure 13C:
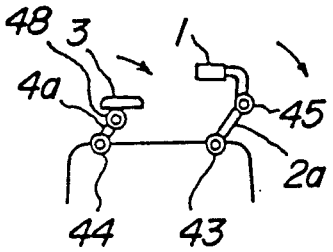
Figure 22:
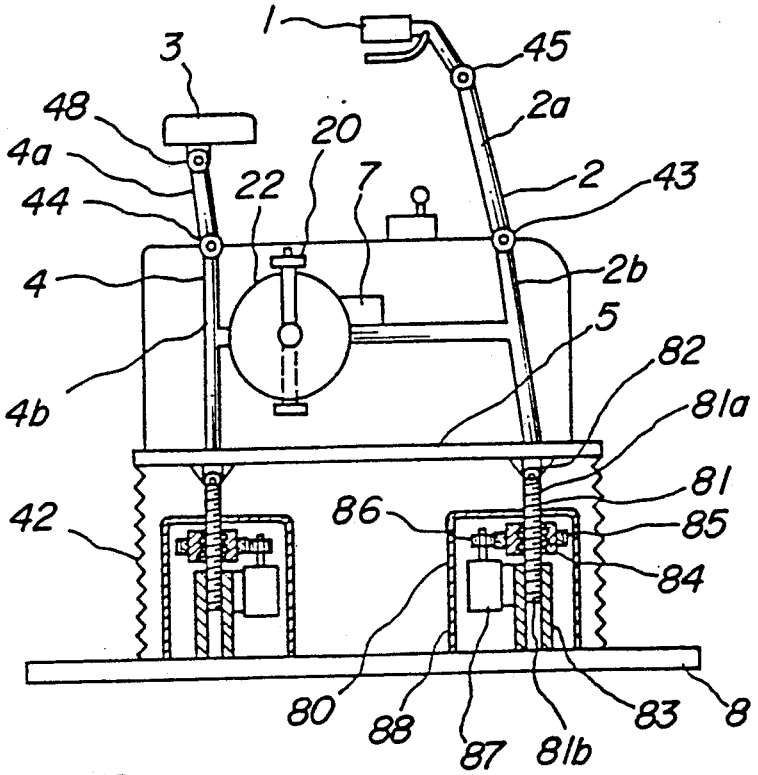
FIG. 22 is a side view of the cycle type athletic equipment according to a sixth embodiment of the invention.
Figure 23:
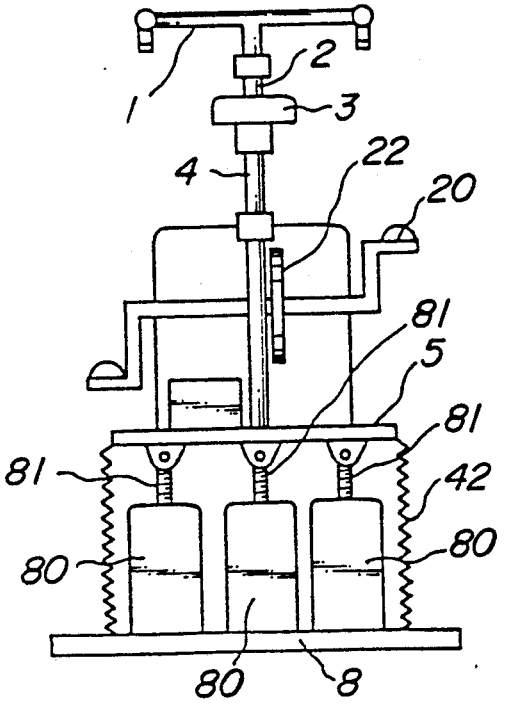
FIG. 23 is a back view of the athletic equipment shown in FIG. 22.
Figure 24:
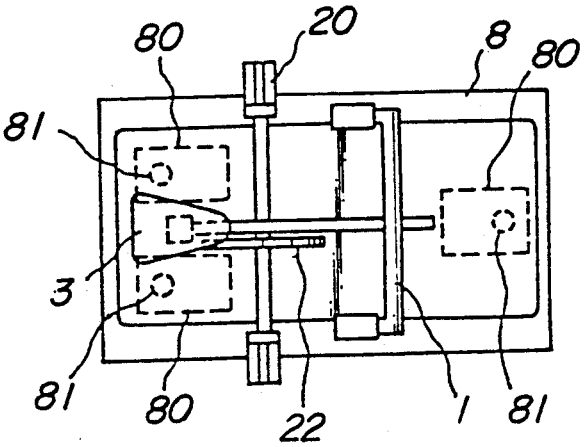
FIG. 24 is a plan view of the athletic equipment shown in FIG. 22.

Referring to FIGS. 22–24 illustrating a sixth embodiment of the invention, the handle post 2 and the seat pillar 4 are secured on the movable support 5 which is a rectangular plate in the same manner as in the third embodiment shown in FIGS. 9–11. In this embodiment, the movable support 5 is supported at three points from the lower side by mechanical actuating means composed of three ball screw mechanisms 80.

Each ball screw mechanism 80 includes an outer threaded rod 81 connected at its upper end 81*a* to the lower surface of the supporting frame 5 through a universal joint 82, a hollow post 83 fixed at its lower end on the supporting stand 8 for slidably receiving the outer threaded rod 81 in the vertical direction, a nut 84 meshed with the outer thread portion of the rod 81 extended from the upper end of the hollow post 83 through balls, a ring gear 85 is rigidly fitted on the outer circumference of the nut 84, a pinion 86 meshed with the ring gear 85, and a reversible motor 87 for drivingly connected to the ring gear 85. The ball screw mechanism is surrounded by a cover 88.

Therefore, the screw rods 81 can be moved up and down by rotating the nuts 84 by the reversible motors 87, thereby tilting the supporting frame 5 and also tilting the handlebar 1 and the saddle seat 3 in the same manner as in the third embodiment described by referring FIG. 12.

Figure 25:
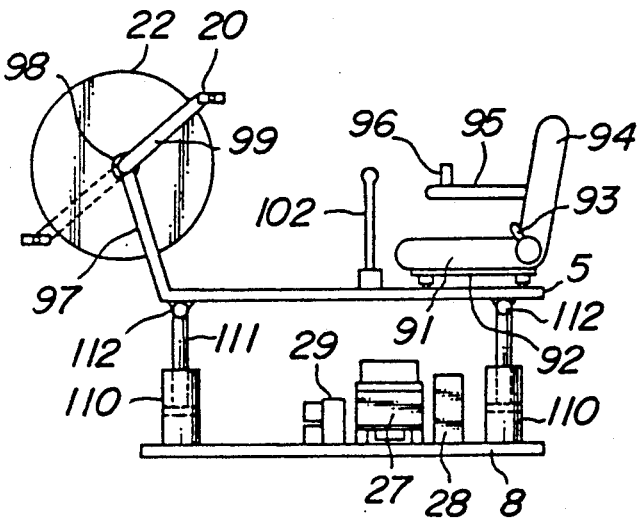
FIG. 25 is a side view of a cycle type athletic equipment according to a seventh embodiment of the invention.
Figure 26:
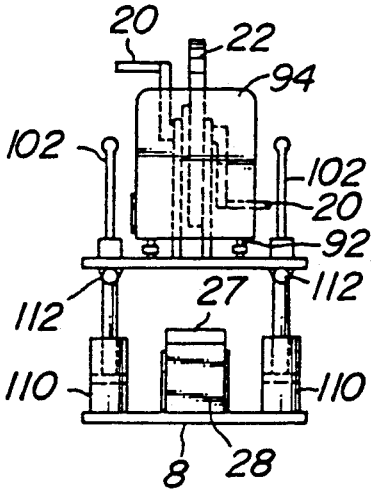
FIG. 26 is a back view of the athletic equipment shown in FIG. 25.
Figure 27:
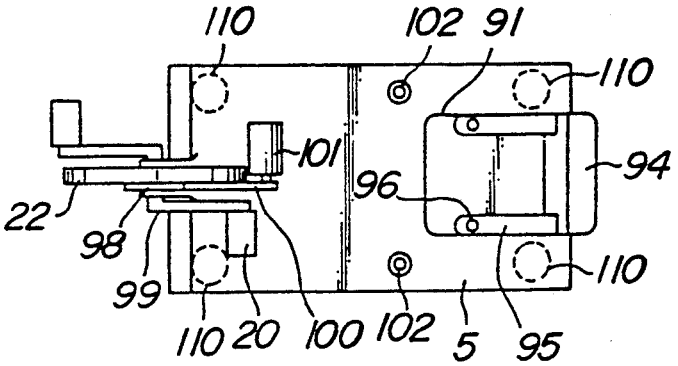
FIG. 27 is a plan view of the athletic equipment shown in FIG. 25.
Figure 28:
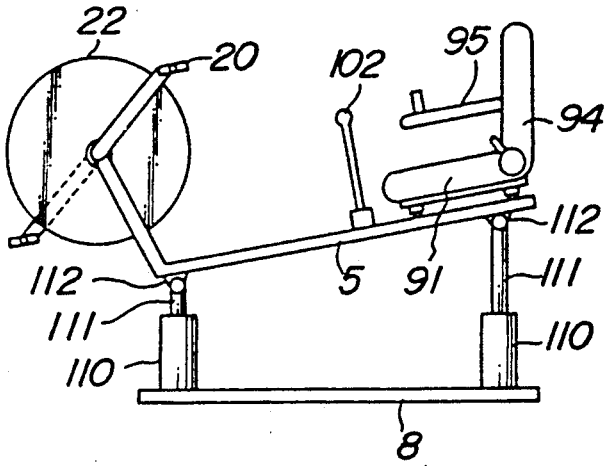
FIGS. 28–31 show the operation of the athletic equipment shown in FIG. 25.
Figure 29:
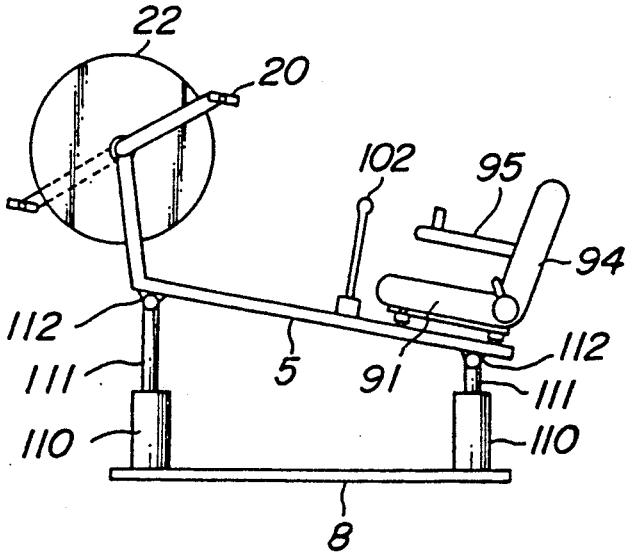
Figure 30:
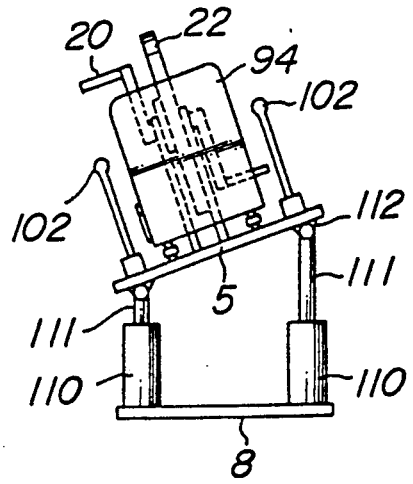
Figure 31:
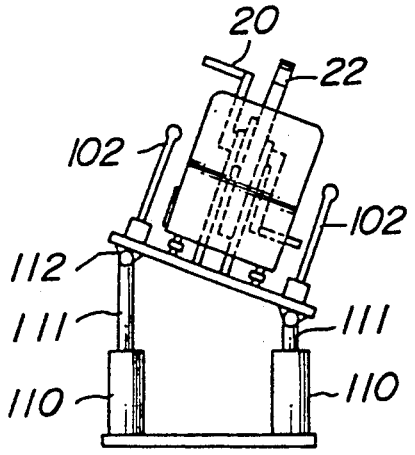

Referring to FIGS. 25–27 illustrating a seventh embodiment of the invention, a seat 91 and a rotary pedal 20 are provided on both end portions of a movable support 5 to space apart from each other in the longitudinal direction. The seat 91 may be constructed to be fixed on a desired position of the movable support 5 by sliding to-and-fro by a conventional sliding mechanism so as to adjust a distance from the rotary pedal 20, such as to be pedaled by legs of a user who sits on the seat 91. The seat back 94 of the seat 91 may be adjusted to a desired reclining position by a conventional reclining adjusting lever 93. A pair of handlebars 95 is secured to the seat back 94 and is provided with a tilting operation switch 96 electrically connected to a solenoid for controlling lifting and tilting means which will be explained hereinafter.

The rotary pedal 20 including a crank axle 98 and crank arm 99 is rotatably mounted on the upper end of a supporting frame 97 upwardly extending from the front end of the movable support 5. A flywheel 22 is fixed to the crank axle 98 and is operatively connected to a rotary pump 101 through a belt 100. The rotary pump 101 is provided with a throttle valve (not shown) for regulating a pump discharge amount, and the throttle valve is electromagnetically controlled by both load regulating levers 102 which can be operated by the user sitting on the seat 91.

In this embodiment, four tilting actuators such as hydraulic cylinders 110 are vertically positioned at four corners of a stationary stand 8. Each hydraulic cylinder 110 is fixed at its lower end to the stationary stand 8 and is movably connected to the under surface of the movable support 5 through a universal joint 112 at the upper end of a piston rod 111. Each actuator 110 is operated by a hydraulic pressure supplied from an oil tank 28 by a pump 27 through a solenoid valve 29 which is operated by means of switches 96 on the handlebars 95.

In case of using a cycle type athletic equipment of the above construction, a user sitting on a seat 91 can pedal the pedal V applied desired load by means of load regulating levers 102, and simultaneously can lift and incline the movable support 5 forward, backward, to the left or the right by selectively extending or contracting the actuators 110 by means of switches 96 on the handlebars 95 as shown in FIGS. 28–31. The movable support 5 can further be three-dimensionally tilted by combining the illustrated movements.

Figure 32:
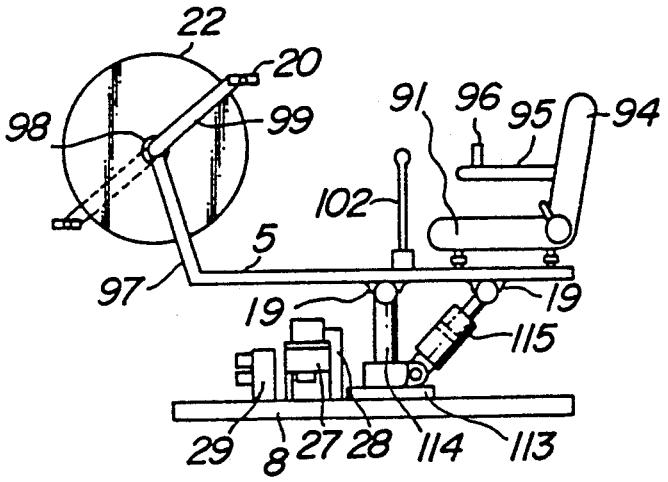
FIG. 32 is a side view of the cycle type athletic equipment according to an eighth embodiment of the invention.
Figure 33:
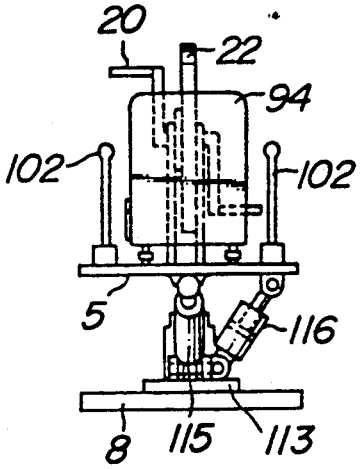
FIG. 33 is a back view of the athletic equipment shown in FIG. 32.
Figure 34:
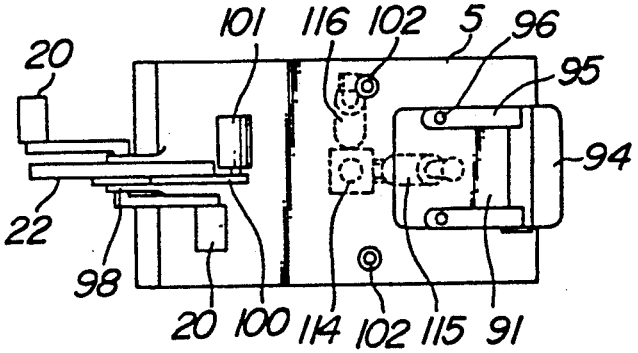
FIG. 34 is a plan view of the athletic equipment shown in FIG. 32.

FIGS. 32–34 illustrate an eighth embodiment of the invention. In this embodiment, the movable support 5 is supported by three actuators, that is a central lifting extensible post 114 composed of a hydraulic cylinder, a forward and backward tilting hydraulic cylinder 115 and a side tilting hydraulic cylinder 116. The central post 114 is fixed at its lower end to a swivel slide 113 mounted on the stationary stand 8 for turning the movable support and is connected at its upper end to the under surface of the movable support 5 through a universal joint 19 so as to be able to vertically lift the movable support. The forward and backward tilting hydraulic cylinder 115 is connected at its lower end to the swivel slide 113 through a universal joint and at the upper end of a hydraulic cylinder to a rear portion of the under surface of the movable support 5 through a universal joint 19 so as to be able to forwardly or backwardly incline the movable support 5. The side tilting hydraulic cylinder 116 is also connected at its lower end to the swivel slide 113 through a universal joint and at the upper end of a piston rod to a side portion of the under surface of the movable support 5 so as to be able to incline the movable support 5 to both sides.

It is understood from the above, the present invention is able to make high training for increasing not only the physical strength of legs but also carpal muscle, pectoral muscle and abdominal muscle, and does not only give great effect to an exercise of the whole body but also considerably improves amusements through free position setting of a handle and a saddle.

What is claimed is:

1. A cycle type athletic equipment comprising a seat, handlebars positioned to be gripped by a user sitting on the seat, rotary pedals positioned to be pedaled by the legs of a user, a flywheel driven by the rotary pedals and subjected to an adjustable load, a movable support for supporting the seat, handlebars, rotary pedals and flywheel, a central post connected at the upper end thereof to the central portion of the movable support by a universal joint and fixed at the lower end thereof to a swivel on a stationary stand for supporting the movable support and permitting turning of the movable support about a vertical axis, a forward and backward tilting actuator and a side tilting actuator, said forward and backward tilting actuator having an upper end connected by a universal joint to said movable support at a point spaced forward or rearward from the central portion of the movable support, said side tilting actuator having an upper end connected by a universal joint to said movable support at a point spaced sideward from the central portion of the movable support, said tilting actuators having lower ends connected to the swivel by universal joints.

2. The athletic equipment claimed in claim 1, wherein the seat has a seat back.

3. The athletic equipment claimed in claim 1, wherein the central post is a central lifting actuator.

* * * * *

UNITED STATES PATENT AND TRADEMARK OFFICE

CERTIFICATE OF CORRECTION

PATENT NO. : 5,035,418

DATED : July 30, 1991

INVENTOR(S) : Masao HIRABAYASHI

It is certified that error appears in the above—identified patent and that said Letters Patent is hereby corrected as shown below:

On the title page item [19], the surname of the inventor, change "Harabayashi" to --Hirabayashi--. and In Item [75] Inventor: change the surname of the inventor from "Harabayashi" to --Hirabayashi--.

Signed and Sealed this

First Day of December, 1992

*Attest:*

DOUGLAS B. COMER

*Attesting Officer*

*Acting Commissioner of Patents and Trademarks*